US007318289B2

(12) United States Patent
Chan

(10) Patent No.: US 7,318,289 B2
(45) Date of Patent: Jan. 15, 2008

(54) CLASP FOR DETACHABLY SECURING FOOTWEAR UPPER

(76) Inventor: Hillary Chan, 230 E. 52nd St., New York, NY (US) 10022

( * ) Notice: Subject to any disclaimer, the term of this patent is extended or adjusted under 35 U.S.C. 154(b) by 227 days.

(21) Appl. No.: 11/142,120

(22) Filed: May 31, 2005

(65) Prior Publication Data

US 2006/0112596 A1 Jun. 1, 2006

Related U.S. Application Data

(63) Continuation-in-part of application No. 11/000,879, filed on Dec. 1, 2004.

(51) Int. Cl.
*A43B 3/12* (2006.01)
*A43B 3/24* (2006.01)

(52) U.S. Cl. ..... 36/11.5; 36/101; 36/15

(58) Field of Classification Search ..... 36/100, 36/101, 15, 11.5

See application file for complete search history.

(56) References Cited

U.S. PATENT DOCUMENTS 2,368,314 A * 1/1945 Marx ..... 36/11.5
2,507,120 A 5/1950 Shapiro
2,519,108 A * 8/1950 Bryant et al. ..... 36/12
2,526,940 A 10/1950 Fello
2,552,943 A * 5/1951 Danielius ..... 36/101
2,761,224 A * 9/1956 Gardiner ..... 36/11.5
2,976,623 A 3/1961 Gallaway
3,154,866 A * 11/1964 Laufbahn ..... 36/101
3,204,346 A * 9/1965 Lockard et al. ..... 36/101
3,686,779 A 8/1972 Sachs
4,363,177 A 12/1982 Boros
4,439,935 A 4/1984 Kelly
4,450,633 A 5/1984 Connelly
4,839,948 A * 6/1989 Boros ..... 24/662
4,887,369 A 12/1989 Bailey
5,896,684 A * 4/1999 Lin ..... 36/101
5,991,950 A 11/1999 Schenkel
6,349,486 B1 * 2/2002 Lin ..... 36/101

* cited by examiner

*Primary Examiner*—Marie Patterson
(74) *Attorney, Agent, or Firm*—Robert L. Epstein; Epstein Drangel Bazerman & James, LLP

(57) ABSTRACT

A clasp for securing an upper to the outsole of an article of footwear is disclosed. The clasp includes first and second releasably interengaging parts, one of which is attached to the upper and the other to the outsole. The part attached to the outsole includes a body defining a recess adapted to slideably receive the part attached to the upper. The recess has an opening through which the part attached to the upper is adapted to extend. The body has a centerline extending through the axis of the recess and the midpoint of the opening. That part also includes a base with a bottom surface adapted to be situated adjacent the outsole. The body is attached to the base such that the centerline of the body forms an obtuse angle with plane of the bottom surface of the base. The base has a top surface that is inclined relative to the bottom base surface. The clasp also has a spring-loaded detent mounted on one of the clasp parts. The detent co-operates with a detent-receiving recess on the other one of the clasp parts to releasably retain the clasp parts in the fully engaged position.

23 Claims, 2 Drawing Sheets

Fig. 1
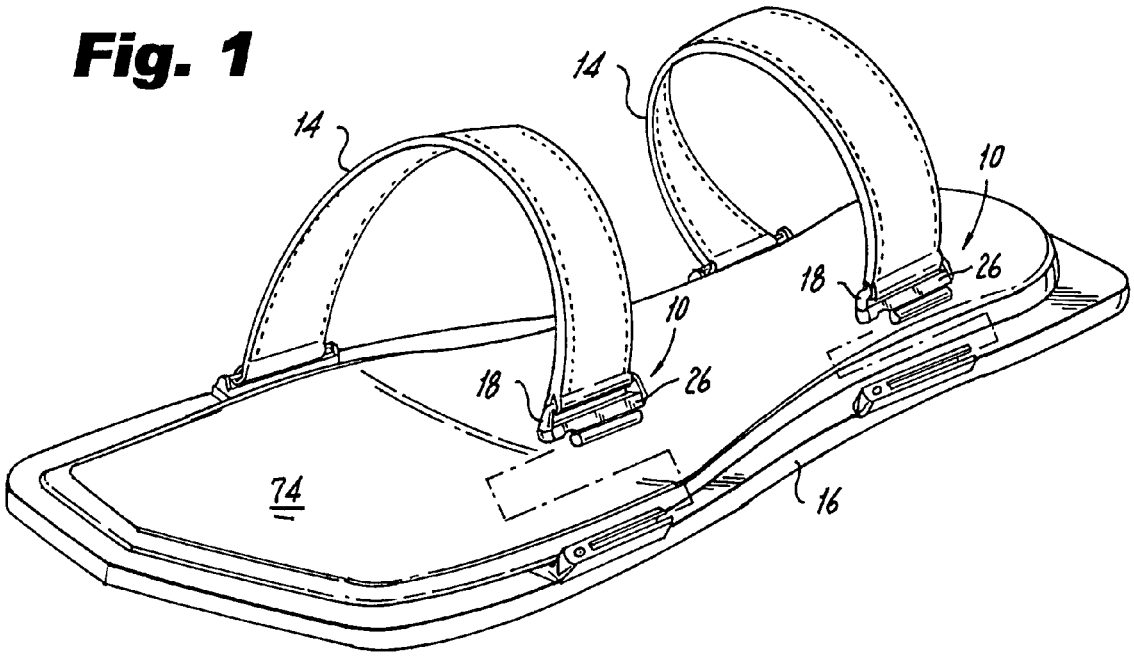
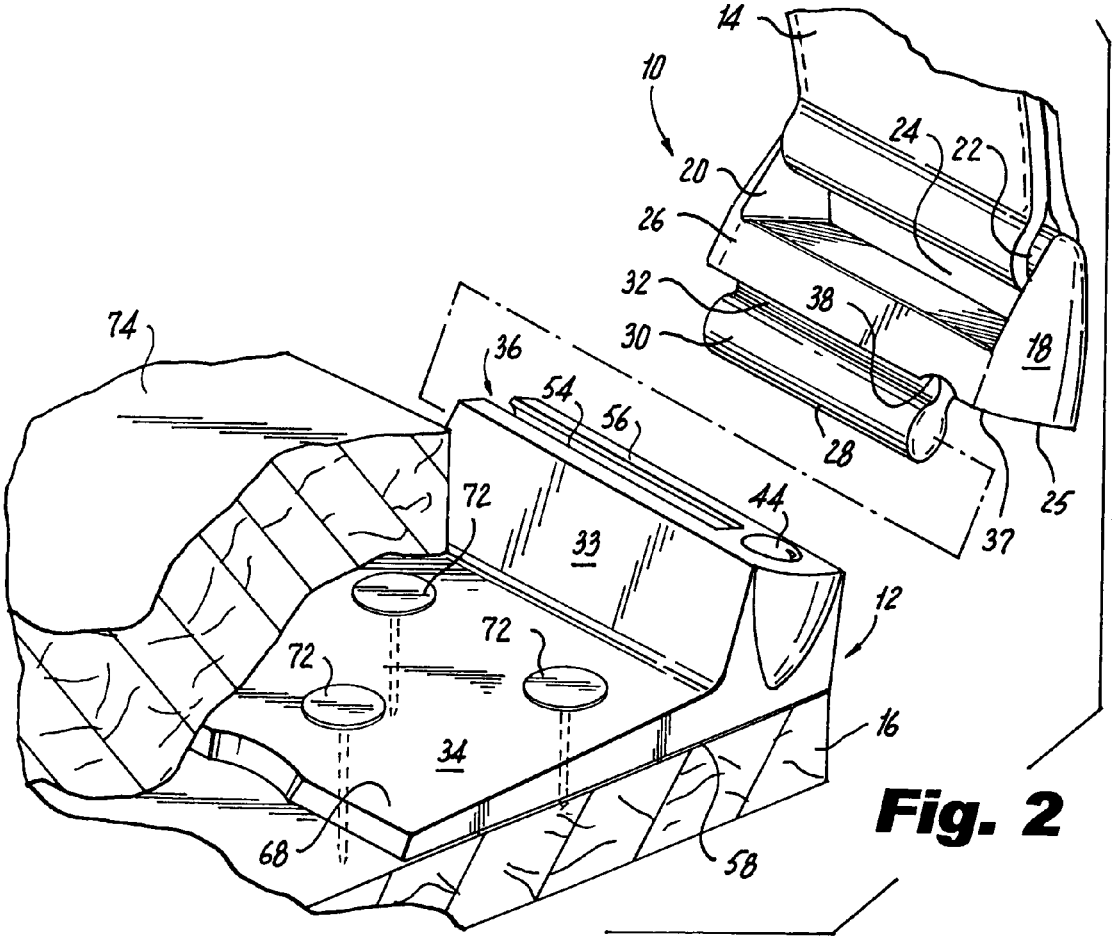
Fig. 2

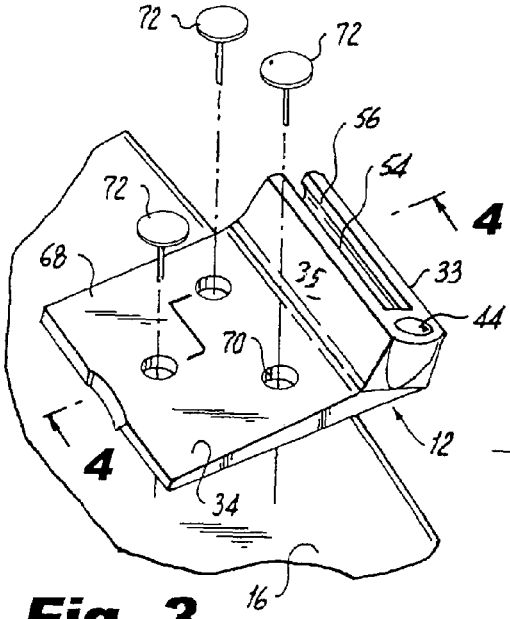
Fig. 3
Fig. 4
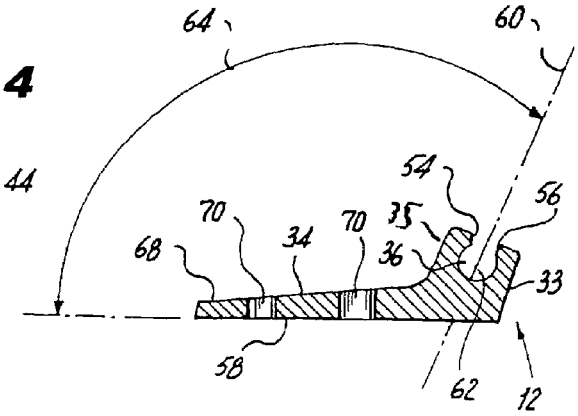
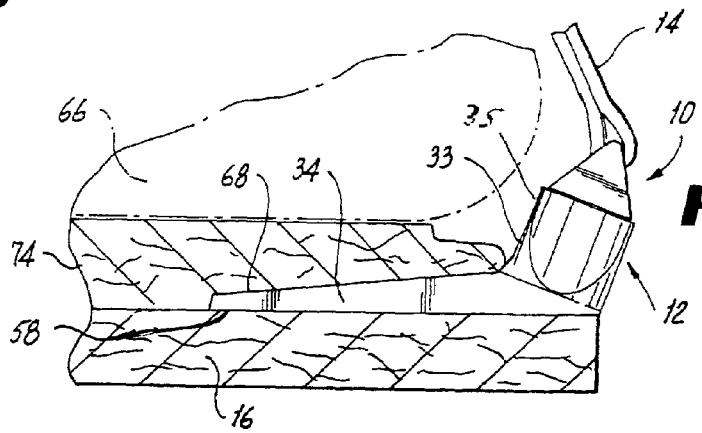
Fig. 5
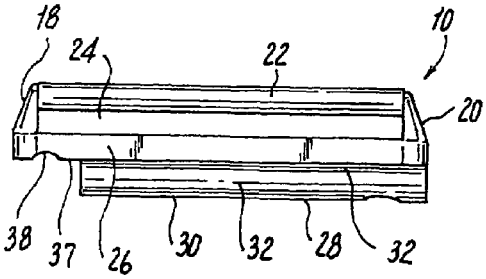
Fig. 6
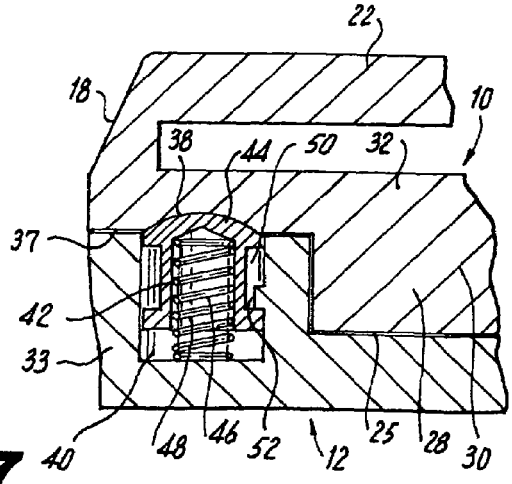
Fig. 7

CLASP FOR DETACHABLY SECURING FOOTWEAR UPPER

CROSS-REFERENCE TO RELATED APPLICATIONS

This application is a continuation-in-part of copending application Ser. No. 11/000,879, filed Dec. 1, 2004, entitled: "Locking Mechanism for Securing Detachable Shoe Uppers" and priority under 35 USC 120 is hereby claimed thereon.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to footwear and more particularly to a clasp for detachably securing an upper, such as strap, to an outsole, to permit uppers to be interchanged to alter the appearance of the footwear.

2. Description of Prior Art Including Information Disclosed Under 37 CFR 1.97 and 1.98

This application is a continuation of copending application Ser. No. 11/000,879, filed Dec. 1, 2004, entitled: "Locking Mechanism for Securing Detachable Shoe Uppers" which is hereby incorporated herein by reference.

The desirability of being able to change the appearance of footwear, for example sandals or high heel soles, by interchanging the uppers, usually in the form of straps, bands or the like, is well documented in the art. However, to be commercially successful, the ends of the upper must be able to be connected to the outsole in a secure manner that permits easy attachment and detachment and, at the same time, does not interfere with the comfort of the wearer. Further, it is desirable that the connecting system be useable with standard outsoles because the design, fabrication and inventorying of customized outsoles for this purpose adds considerable expense to the product.

It is known, for example, to use an attachment system in which one part pushed down into a recess formed in the outsole. That system is undesirable because it cannot be made to withstand the forces involved and because the outsoles must be customized for this purpose.

Another system that has been used is to form a channel in the outsole into which a part attached to the end of the strap is slideably received. Here again strength may be an issue and the outsole must be customized. Further, the outsole must be made wider than usual to accommodate the foot, and hence may not be appropriate for certain types of footwear, particularly high fashion dress shoes for women.

Others have attempted to use various types of connecting mechanisms that include detachable parts, one of which is fixed to the outsole. However, if made strong enough to withstand the forces involved, those mechanisms tend to make the footwear uncomfortable to wear because they create a bulge under the foot or rub against the side of the foot as the user walks.

BRIEF SUMMARY OF THE INVENTION

It is, therefore, a prime object of the present invention is to provide a clasp for detachably securing a footwear upper that is strong enough to withstand the forces involved and at the same time is comfortable to wear.

It is another object of the present invention to provide a clasp for detachably securing a footwear upper that permits the upper to be easily and quickly detached from the outsole without the necessity of special tools.

It is another object of the present invention to provide a clasp for detachably securing a footwear upper that does not to detract from the appearance of the footwear.

It is another object of the present invention to provide a clasp for detachably securing a footwear upper that is simple in design and does not add appreciably to the cost of the product.

It is another object of the present invention to provide a clasp for detachably securing a footwear upper that does not require a customized outsole.

In the above mentioned copending application, a clasp is described that is intended to meet the above objectives. However, it has been determined that the structure of the clasp disclosed therein interferes with the comfort of the wearer and additionally does not always securely retain the engagement of the clasp parts leading to accidental detachment thereof. The present invention is an improved structure that overcomes those disadvantages.

In general, those objects are achieved by the present invention through the use of a two part clasp in which the part attached to the end of the upper is slideably received and reliably retained within a recess formed in a portion of the part of the clasp attached to the outsole by a spring-loaded detent. That portion of the part of the clasp attached to the outsole is situated at an obtuse angle relative to the base of the part so it does not interfere with the foot. Further, the top surface of the base is tapered and rounded to further enhance the comfort of the wearer.

More specifically, a clasp is provided for securing an upper to the outsole of an article of footwear. The clasp consists first and second releasably engagable parts. The first part is attached to the upper. The second part is attached to the outsole. The second part has a body defining a recess adapted to slidably receive the first part. The recess has an opening through the first part extends. The centerline of the body extends through the axis of the recess and the midpoint of the opening. The second part further includes a base with a first surface adapted to be situated adjacent of the outsole. The first base surface is situated substantially in a plane. The body of the second part is attached to the base with the centerline forming an obtuse angle with the plane of the first base surface.

The base has a surface opposite to the first base surface. That base surface is inclined relative to the first base surface.

The clasp also includes a spring-loaded detent mounted on the second part. The detent co-operates with a detent-receiving recess in the first part to releasably retain the first part of the clasp within the recess in the second part.

The footwear includes an insole. The insole is situated over the base of the second part of the clasp.

Preferably, the obtuse angle is greater than 110 degrees. More preferably, the obtuse angle is between 110 degrees and 120 degrees. Most preferably, the obtuse angle is about 112 degrees.

In accordance with another aspect of the present invention, a clasp is provided for securing an upper to the outsole of an article of footwear. The clasp includes first and second releasably engagable parts. The first part is attached to the upper. The second part is attached to the outsole. The second part includes a body defining a recess adapted to slidably receive the first part. Spring-loaded detent means are situated on one of the parts. Detent-receiving means are situated on the other of the parts. The detent means and detent-receiving means cooperate to releasably retain the first part in the recess.

The recess has an opening through which the first part is adapted to extend. The body of the second part has a centerline extending through the recess axis and the mid-point of the opening. The second part also includes a base. The base has a first surface adapted to be situated adjacent the outsole. That base surface is situated substantially in a plane. The centerline of the body forms an obtuse angle with the plane of the first base surface.

The base has a surface opposite to the first base surface. That base surface is inclined relative to the first base surface.

The footwear also includes an insole. The insole is situated over the base of the second clasp part.

Preferably, the obtuse angle is more than 110°. More preferably, the obtuse angle is between 110 degrees and 120 degrees. Most preferably, the obtuse angle is about 112 degrees.

The detent has a substantially rounded head. It is received in a detent-receiving bore in the second part. Means are provided for movably retaining the detent within the detent-receiving bore. The detent-receiving bore is spaced from the recess in the body of the second clasp part. Preferably, the detent-receiving bore is deeper than the recess.

Further, means are provided for securing the base of the second clasp part to the outsole.

BRIEF DESCRIPTION OF THE SEVERAL VIEWS OF DRAWINGS

To these and to such other objects that may hereinafter appears, the present invention relates to clasp for detachably securing an upper as described in detail in the following specification and recited in the annexed claims, taken together with the accompanying drawings, in which like numerals refer to like parts in which:

FIG. 1 is an isometric view of an article of footwear in the form of a sandal with the clasp of the present invention;

FIG. 2 is an enlarged isometric view of the parts of the clasp of the present invention, showing the base of one part of the clasp mounted to the outside;

FIG. 3 is an isometric view of the base of one part of the clasp of the present invention; showing how the base is mounted to the outside;

FIG. 4 is a cross-sectional view taken along line 4-4 of FIG. 3;

FIG. 5 is an enlarged end view of the clasp of the present invention shown in FIG. 2, but with the clasp parts interengaged;

FIG. 6 is a front view of the part of the clasp connected to the upper; and

FIG. 7 is a cross-sectional enlarged view of a portion of the interengaged clasp parts, showing the spring-loaded detent in detail.

DETAILED DESCRIPTION OF THE INVENTION

FIG. 1 shows a typical use of the clasp of the present invention of footwear, here illustrated as a sandal. However, it should be understood that the clasp of the present invention could be used on any type of footwear having an upper and an outsole.

As seen in FIG. 1, the clasp of the present invention consists of two interengageable parts, a first part 10 and a second part 12. Preferably, parts 10 and 12 are each made of stainless steel with a tensile strength of at least 200,000 lbs/psi such that even the thinnest portions of the parts can withstand the forces to which the clasp will be subjected by an adult without breaking.

First part 10 is connected to the shoe upper, in this case shown for purposes of illustration as a sandal strap 14. However, it should be appreciated that depending upon the type of footwear the clasp is used on, the upper may take any suitable form, such as a strap for a women's high heel shoe, a sneaker top or the like.

Second part 12 is fixed to the footwear outsole, shown here as a sandal outsole 16. However, the form of the outsole will, of course, depend upon the type of footwear involved. Second part 12 may be mounted on the top surface of the outsole 16 or in a recess provide in the top surface of the outsole formed for that purpose.

Referring now to FIGS. 2 and 6, it can be noted that first part 10 of the clasp includes of end parts 18, 20. A bar 22 extends between end parts 18, 20. Spaced from bar 22 by a recess 24 is a generally rectangular member 26. Member 26 also extends between end parts 18, 20. The end of strap 14 extends through recess 24 and is stitched or glued to itself so as to encircle bar 22, as seen in FIG. 2.

A male interengaging element 28 extends downwardly from the bottom surface 25 of member 26. Element 28 consists of an elongated, generally cylindrical part 30 connected to the bottom surface 25 of member 26 by a thinner neck portion 32. Neck portion 32 serves to connect cylindrical part 30 in spaced relation to the bottom surface 25 of member 26.

Second part 12 of the clasp includes a body 33 and a base 34. Body 33 includes an elongated internal, generally cylindrical recess 36 that is open at the rear end such that it can slideably receive part 30 of first clasp part 10 when the latter is moved into the former in a direction substantially parallel to the plane of the outsole.

Although the drawings illustrate element 28 as a portion of first part 10 of the clasp and the recess 36 of body 33 as a portion of second part 12, it should be understood that elements 28 and recess 36 could be interchanged, with element 28 being a portion of the second part 12 of the clasp and the recess 36 being in first part 10.

Further, although part 30 of element 28 is illustrated as being cylindrical and the body 32 is illustrated as defining a recess 36 that is cylindrical, it should be understood that part 30 could have any cross-sectional shape, such as triangular, square, rectangular etc. as long as the recess in recess 36 has a corresponding cross-sectional shape.

It should also be understood that since it is desirable to have the male part of the clasp slide into the female part from the rear, mirror image clasps are preferably utilized on opposite sides of the upper.

As best seen in FIGS. 6 and 7, element 28, although elongated in the direction of the axis of bar 22, does not extend the entire length of the first part 10. In fact, the front end of element 28 is spaced from the plane of end part 18 of first part 10 so as to expose a portion 37 of the bottom surface 25 of first part 10. Exposed portion 37 of bottom surface 25 of part 10 has an arcuate indentation 38 extending transversely to the axis of first part 10.

As seen in FIG. 7, the front end of body 33 of second part 12 has a cylindrical bore 40. Bore 40 is adapted to moveably receive a spring-loaded detent 42. It is preferably somewhat deeper than the depth of recess 36.

Detent 42 is a generally "mushroom shaped" cylindrical element with an arcuate or rounded head 44. Detent 42 can be made of metal or plastic. The detent has an internal recess 46 into which a spring 48 is received. Spring 48 must be made of stainless steel in order to exert sufficient force on the detent to reliably retain the clasp parts in the fully engaged position.

Head 44 has a rounded exterior surface to maximize surface contact with first part 10 so as to retain the clasp parts in the fully engaged position. The curvature of head 44 also serves to cam the detent out of the way as the parts slide together, allowing for easy attachment and detachment of the clasp parts.

Detent 42 also has a circumferential groove 50. A protrusion 52 extends inwardly from the wall of bore 46 and is received in circumferential groove 50 of the detent to moveably retain the detent within the bore so that it can move between a depressed position, against the urging of spring 48, in which the top of head 44 is substantially coplanar with the top surface of body 33, and an extended position, in which head 44 is located above the surface of body 33.

FIG. 7 shows detent 42 in its most extended position, with head 44 seated in indentation 38 of bottom surface 25 of first part 10. It is urged toward that position by spring 48 to "lock" or retain first part 10 in second part 12, with part 30 of element 28 fully slideably received within recess 36 in body 33 of second part 12. Spring 48 is sufficiently strong so as to keep detent 42 in indentation 38, and hence the parts of the clasp interengaged, until a relatively large force is applied in the direction of the axis of first part 10, toward the open end of recess 36, to cam detent 42 out of the way in order to withdraw element 28 from recess 36 and remove first part 10 from second part 12 and thus detach the sandal strap (upper) from the sandal outsole.

Circumferential detent groove 50 and protrusion 52 cooperate to limit the upward movement of detent 42 within bore 40. Thus, spring 48 cannot push the detent out of the bore when the clasp parts are detached.

As best seen in FIGS. 3 and 4, recess 36 in body 33 of second part 12 has a neck portion that substantially corresponds in dimension to neck portion 32 of element 28 of first part 10. The opposing spaced edges 54, 56 of body 33 define that neck and the open top of recess 36 such that first part 10 can extend through the top of recess 36 when part 30 is slideably received therein.

An important feature of the present invention is the fact that body 33 forms an obtuse angle with the plane of the bottom surface 58 of base 34 of second part 32. More specifically, a line 60 extending through axis 62 of recess 36 and the midpoint of the gap between edges 54, 56 meets the plane of the bottom of surface 58 of base 34 forms an obtuse angle, illustrated by arc 64 in FIG. 4.

As seen in FIGS. 3, 4 and 5, body 33 of second part 12 includes a substantially planar side surface 35 that faces inwardly toward foot 66. Surface 35 of body 33 lies in a plane that is substantially parallel to line 60. Thus, surface 35 is situated at an obtuse angle relative to bottom surface 58 of base 34.

That obtuse angle is preferably greater than 110 degrees, more preferably between 100 degrees and 120 degrees and most preferably, approximately 112°. This feature is important because the body of the clasp part meets the plane of the bottom surface of the base at an angle of less than 110°, such as 90° for example, it will interfere with and rub against the side of the foot 66 when the wearer puts his or her weight on the outsole, causing discomfort to the foot. Repeated weight bearing by the foot, such as in walking, could case severe discomfort, even damage to the tissues of the foot, making clasps without this feature virtually unusable.

In the present invention, angling the body of the clasp part outwardly relative to the plane of the base in this manner compensates for the upward curvature of the outer edge of the outsole. It also spaces the surface of the foot 66 well away from the body of the clasp part, as seen in FIG. 5, so that it cannot contact the foot.

FIGS. 4 and 5 show that the top surface 68 of base 34 is inclined relative to bottom surface 58. This also contributes to the comfort of the foot.

FIGS. 2 and 3 show that base 34 is provided with holes 70 adapted to receive the shafts of flat headed nails 72 to fix the base to outsole 16. Preferably, three holes 70 are provided in a triangular pattern, with two of the three spaced an equal distance from the body of the clasp part. Alternatively, adhesive or other conventional fasteners could be used from this purpose.

As seen in FIGS. 1, 2 and 5, to further enhance the comfort of the wearer, an insole 74 can be fixed to the upper surface of outsole 15 and over the base 34 of each of the clasps, if desired. The insole 74 is preferably held in place by a layer of adhesive.

It will now be appreciated that the present invention relates to a clasp for securing an upper to the outsole of an article of footwear. The clasp includes first and second releasably interengaging parts, one of which is attached to the upper and the other to the outsole. The part attached to the outsole includes a body defining a recess adapted to slideably receive the part attached to the upper. The recess has an opening through which part attached to the upper is adapted to extend. The body has a centerline extending through the axis of the recess and the midpoint of the opening. That part also includes a base with a bottom surface adapted to be situated adjacent the outsole. The body is attached to the base such that the centerline of the body forms an obtuse angle with plane of the bottom surface of the base.

The base has a top surface. The top base surface is inclined relative to the bottom base surface.

The clasp also has a spring-loaded detent mounted on one of the clasp parts. The detent co-operates with a detent-receiving recess on the other one of the clasp parts to releasably retain the clasp parts in the fully engaged position.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

I claim:

1. An article of footwear comprising an upper, an outsole and a clasp for securing said upper to said outsole, said clasp comprising first and second releasably engagable parts, said first part being attached to the upper and said second part being attached to the outsole, said second part comprising a body defining a recess adapted to slideably receive said first part, spring-loaded detent means situated on one of said first and said second parts and detent-receiving means situated on the other of said first and said second parts so as to releasably retain said first part in said recess, wherein said detent comprises a substantially rounded head.

2. The article of claim 1 wherein said upper comprises a strap.

3. An article of footwear comprising an upper, an outsole and a clasp for securing said upper to said outsole, said clasp comprising first and second releasably engagable parts, said first part being attached to the upper and said second part being attached to the outsole, said second part comprising a body defining a recess adapted to slideably receive said first part, spring-loaded detent means situated on one of said first and said second parts and detent-receiving means situated on the other of said first and said second parts so as to releasably retain said first part in said recess, wherein said detent is received in a detent-receiving bore in said second part and further comprising means for movably retaining said detent within said detent-receiving bore.

4. The article of claim 3 wherein said detent-receiving bore is spaced from said recess on said second part.

5. The article of claim 3 wherein said detent-receiving bore is deeper than said recess.

6. The article of claim 3 wherein said upper comprises a strap.

7. An article of footwear comprising an outsole with a surface, an upper, and a clasp for removably securing said upper to said article, said clasp comprising first and second interengaging parts, said first part being attached to said upper and comprising an engaging member, said second part comprising a base with a surface fixed to said outsole surface and a body extending from said base comprising a substantially planar side surface situated at an obtuse angle relative to said base surface, said body having an end with an opening and defining a recess into which said engaging member is adapted to be received by sliding same through said end opening, to engage said first and second parts.

8. The article of claim 7 further comprising a spring-loaded detent mounted on one of said parts and co-operating with a detent-receiving recess one the other of said parts to releasably retain said engaging member within said recess.

9. The article of claim 7 wherein the footwear includes an insole with an edge and wherein said body is situated proximate said insole edge.

10. The article of claim 7 wherein said obtuse angle is more than 110 degrees.

11. The article of claim 7 wherein said obtuse angle is between 110 degrees and 120 degrees.

12. The article of claim 7 wherein said obtuse angle is about 112 degrees.

13. The article of claim 7 wherein said upper comprises a strap.

14. An article of footwear comprising an outsole, an upper and a clasp for releasably securing said upper to said outsole, said clasp comprising first and second interengageable parts, said first part being attached to said upper and comprising an engaging member elongated in a given direction, said second part being attached to the outsole, said second part comprising a body defining a recess adapted to receive said engaging member as it is moved in said given direction, spring-loaded detent means situated on one of said first and said second parts and detent-receiving means situated on the other of said first and said second parts, so as to releasably retain said engaging member in said recess, when said engaging member has been received within said recess.

15. The article of claim 14 wherein said article further comprises an insole with an edge and wherein said body is situated proximate said insole edge.

16. The article of claim 14 wherein said recess has an opening through which said first part is adapted to extend, said second part has a centerline extending across the axis of said recess and through the midpoint of said opening, said second part further comprising a base, said base having a surface adapted to be situated adjacent the outsole, said base surface being situated substantially in a plane, wherein said centerline forms an obtuse angle with said plane of said base surface.

17. The article of claim 16 wherein said obtuse angle is more than 110 degrees.

18. The article of claim 16 wherein said obtuse angle is between 110 degrees and 120 degrees.

19. The article of claim 16 wherein said obtuse angle is about 112 degrees.

20. The article of claim 16 further comprising means for securing said base to said outsole.

21. The article of claim 14 wherein said upper comprises a strap.

22. An article of footwear comprising an insole having an edge, an outsole having a surface to which said insole is attached, an upper and a clasp for removably securing said upper to said outsole, said clasp comprising first and second interengaging parts, said first part being attached to said upper and comprising an engaging member, said second part comprising a base extending between said insole and said outsole with a surface adjacent said outsole surface and a body extending from said base with a substantially planar side surface situated proximate said insole edge and at an obtuse angle relative to said base surface, said body having defining a recess into which said engaging member is adapted to be received, to engage said first and second parts.

23. The article of claim 22 wherein said upper comprises a strap.

* * * * *